United States Patent [19]

Franklin et al.

[11] Patent Number: 4,611,805

[45] Date of Patent: Sep. 16, 1986

[54] EXERCISE DEVICE

[75] Inventors: Irving H. Franklin, Brockton; Kurt M. Gluck, N. Easton, both of Mass.

[73] Assignee: Franklin Sports Industries, Inc., Stoughton, Mass.

[21] Appl. No.: 761,911

[22] Filed: Aug. 2, 1985

[51] Int. Cl.[4] ..... A63B 21/04

[52] U.S. Cl. ..... 272/136; 272/142; 272/900; 272/DIG. 4; 272/143

[58] Field of Search ..... 272/900, 901, 136, 142, 272/135, 93, DIG. 4, 143, 134, 137, 138, 139, 141; 24/265 EC, 265 R, 458

[56] References Cited

U.S. PATENT DOCUMENTS

| | | | |
|---|---|---|---|
| D. 197,781 | 3/1934 | Bonomo . | |
| 3,118,441 | 1/1964 | George . | |
| 3,673,643 | 7/1972 | Kindell | 24/458 |
| 3,680,858 | 8/1972 | Ossenkop et al. . | |
| 3,873,088 | 3/1975 | Panepinto . | |
| 4,059,265 | 11/1977 | Wieder et al. . | |
| 4,116,434 | 9/1978 | Bernstein . | |
| 4,170,351 | 10/1979 | Ozbey et al. | 272/136 X |
| 4,185,816 | 1/1980 | Bernstein . | |
| 4,304,402 | 12/1981 | Ripp . | |
| 4,373,716 | 2/1983 | Pagani . | |
| 4,378,939 | 4/1983 | Wild . | |
| 4,449,275 | 5/1984 | Nava | 24/265 EC X |
| 4,468,022 | 8/1984 | Wu . | |
| 4,492,375 | 1/1985 | Connelly | 272/134 |

FOREIGN PATENT DOCUMENTS

| | | | |
|---|---|---|---|
| 1175335 | 12/1969 | United Kingdom | 272/142 |
| 2148136 | 5/1985 | United Kingdom | 272/901 X |

*Primary Examiner*—Richard J. Apley
*Assistant Examiner*—Robert W. Bahr
*Attorney, Agent, or Firm*—Kenway & Jenney

[57] ABSTRACT

A multi-position, multi-purpose portable exercise unit including a support bracket for securing the device to a door or bed frame, a T-shaped exercise bar, a multi-position bracket for positioning the exercise bar relative to the support bracket, and contoured handles connected to the exercise bar by heavy elastic cords with snap-in clips.

7 Claims, 5 Drawing Figures

EXERCISE DEVICE

BACKGROUND OF THE INVENTION

This invention relates to exercising apparatus and more particularly to a portable, versatile chest pull type exercising device.

A number of exercise devices are presently available which comprise elastic or flexible members secured to a stationary object. Examples of such devices for performing chest pull exercises are shown in U.S. Pat. Nos. 3,680,858; 4,373,716; and 4,304,402. Other exercise devices which attach to a stationary support such as a door or bed frame for use with sit up type exercises include those disclosed by U.S. Pat. Nos. 4,468,022; 4,378,939; 4,185,816; and 4,116,434.

None of these devices are positionable in a variety of ways, so that isometric flexing, rowing, lifting and stretching exercises, as well as sit up and chest pull exercises, may be performed with only minor, easy adjustments of the device. Further, most of these devices are not lightweight and portable for easy storage or carrying for use not only at home but at the office or while traveling.

It is therefore an object of the invention to provide a multi-purpose exercise device which may be used for isometric flexing, rowing, lifting and stretching exercises to help trim and tone the upper and lower body, and converts to a sit up and chest pull exercise device.

It is a further object of the invention to provide an exercise device which is compact, light weight, and easy to carry and store.

Yet another object of the invention is to provide an exercise device which is quickly and easily adjusted for use by people of various sizes and strengths.

SUMMARY OF THE INVENTION

An exercise device which is portable, light weight and attaches easily to a door frame or similar structure comprises a support attachment bracket, a T-shaped exercise bar, and two handles connected to the bar by heavy elastic cords. A springbar bracket connecting the support bracket to the exercise bar has multiple settings, thereby providing a means for positioning the exercise bar according to the individual user's height and size, as well as to adapt it for use with sit up or chest pull type exercises. Heavy elastic cords, connected at both ends by snap-in clips, secure the handles to connectors on the exercise bar. The handles and connectors each have a plurality of spaced apertures so that one or more cords may be arranged in a variety of ways.

DETAILED DESCRIPTION OF THE INVENTION

Figure 1:
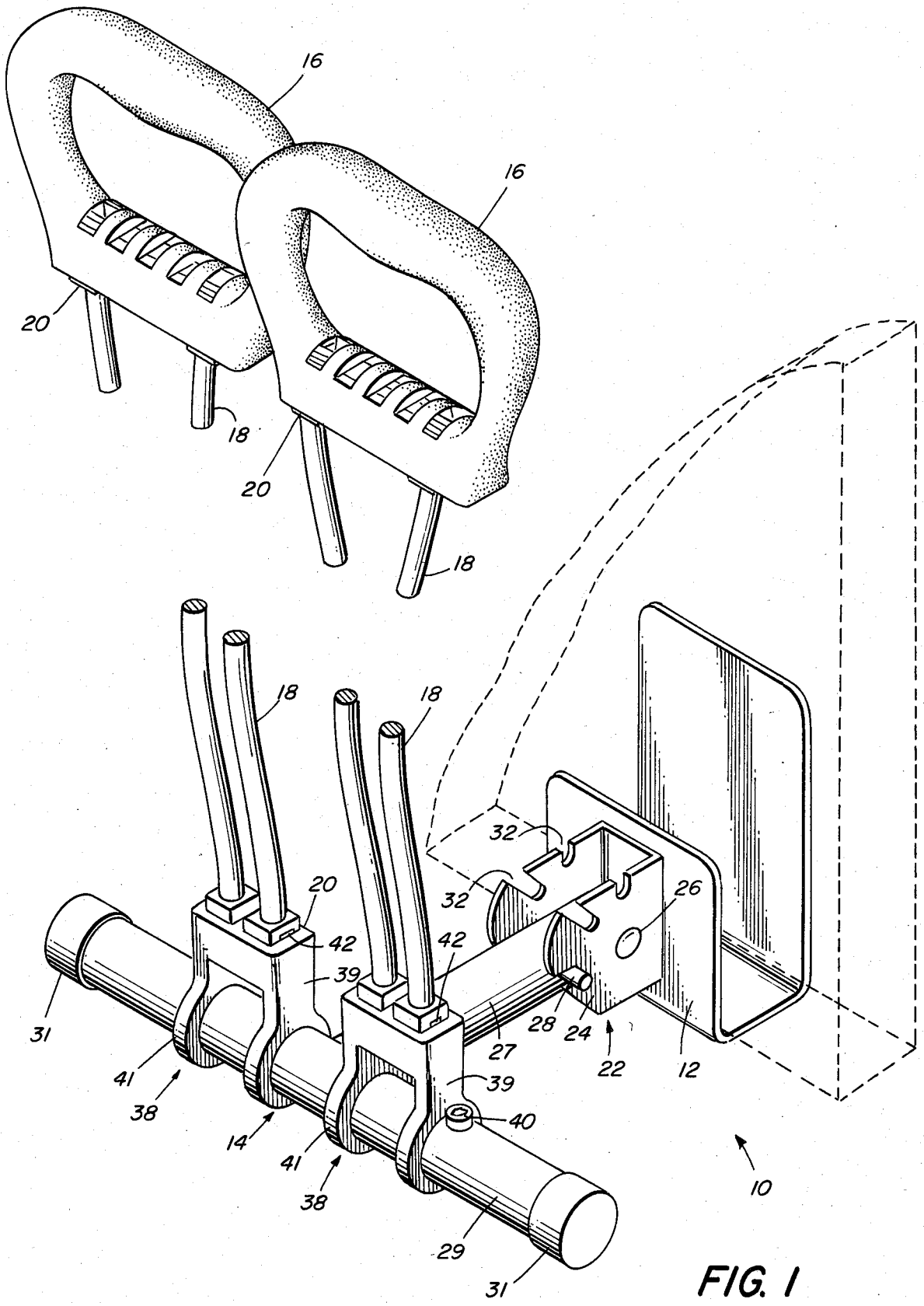
FIG. 1 is a perspective view of the exercise device.

The exercise device of the present invention is versatile, lightweight and compact. It is useful for a variety of isometric stretching and lifting exercises. It may be used for both sit up and chest pull type exercises. Because it is portable and easily stored or carried, the device is useful both at home and while traveling. The advantages of this device are explained in more detail with reference to FIGS. 1-5.

The exercise device 10 comprises a support bracket 12 for securing the device to a structure such as a door frame, a multi-positionable, T-shaped exercise bar 14, two molded, contoured handles 16, and flexible, elastic cords 18 connecting the handles to the exercise bar 14 by means of snap-in clips 20 at both ends of the cords.

As shown in FIG. 1, the bracket 12 for attaching the device 10 to a door frame (shown in phantom) or other structrue is generally U-shaped and preferably of standard heavy metal construction. The preferred embodiment includes protective rubber door guards on the inside between the structure and the bracket 12. The support bracket 12 has a second U-shaped bracket 22 extending outwardly from the support bracket 12 along an axis generally perpendicular to the support structure. The bracket 22 is welded or bolted to the bracket 12 so that the "arms" 24 open outward towards the exercise bar 14.

The exercise bar 14 consists of a central shaft 27 and a cross shaft 29 which extends across the end of shaft 27 in a generally perpendicular direction. The T-shaped exercise bar 14 is rotatably mounted in the bracket 22 by means of a pin or bolt 26. In the preferred form, the exercise bar 14 is made of heavy gauge 1¼ inch chrome plated steel tubing. The ends of the cross shaft 29 are covered by caps 31, preferably of nylon or other resilient material.

Figure 2:
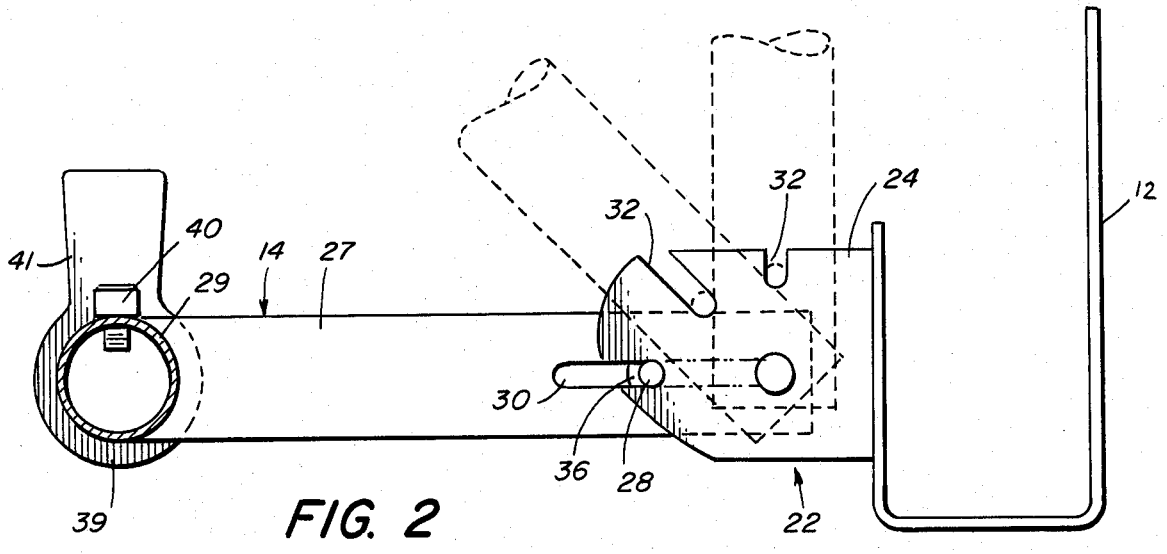
FIG. 2 is a view partially in section of the spring-bar bracket of the exercise device of FIG. 1.
Figure 3:
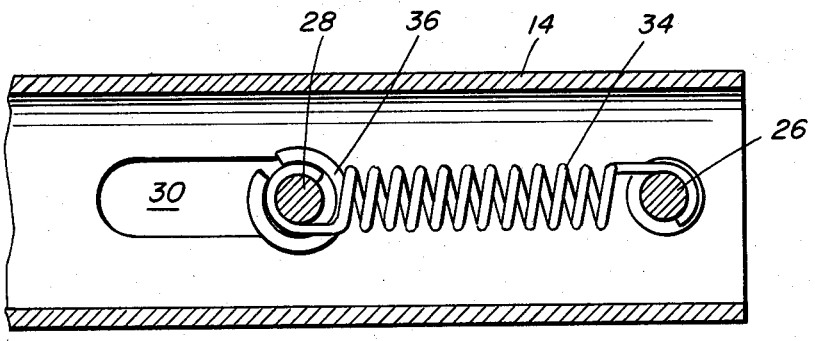
FIG. 3 is a sectional view of the spring-bar of FIG. 2.

As shown in FIG. 2, the angle of inclination of the central shaft 27 relative to the support bracket 12 is adjusted by pivoting the shaft 27 around the bolt 26 in the bracket 22. A spring bar 28 intersects the lower end of the shaft 27 and is movably positioned within a slot 30 extending along the central axis of the bar 14. The shaft 27 is secured relative to the bracket 22 by locating the spring bar in one of two or more openings 32 in the bracket arms 24. The spring bar 28 extends across the central shaft 27 in a generally perpendicular direction and is retained within the slot 30 by a spring 34, as shown in detail in FIG. 3. The spring 34 is secured at one end to the bolt 26 and to the spring bar 28 at the other. Washers 36 on the spring bar 28 center the spring bar 28 between the bracket arms 24. The position of the exercise bar 14 is altered by lifting the spring bar 28 out of the opening 32 in the multi-position bracket 22, pivoting the exercise bar 14 to the desired opening 32, and releasing the spring bar 28. The spring 34 pulls the spring bar 28 into the opening 32. The exercise bar 14 is now secured in place at the desired angle.

Connectors 38 for attaching the flexible cords 18 and handles 16 to the exercise bar 14 consist of upper portions 39 with apertures 42 for the snap-in clips 20 on the elastic cords 18 and lower portions 41 which encircle the cross shaft 29. In the preferred embodiment, the connectors 38 are made of a molded plastic. The connectors 28 are retained on the shaft 29 by the central shaft 27 on one side and a screw 40 on the other. The screw 40 and cap 31 are easily removed so that the connector 38 may be slid off the shaft 24. An allen screw 40 may be used to facilitate removal without tools. It may be desirable to remove the connectors 38 when the device 10 is used for sit up exercises. Each connector 38 has at least two spaced apertures 42 for retaining the snap-in clips 20 at the ends of the elastic cords 18. In the preferred form, the clips 20 are also made of a resilient plastic or nylon. The clips 20 are generally U-saped with the cords 18 attached at the upper or "bottom of the U" end.

Figure 4:
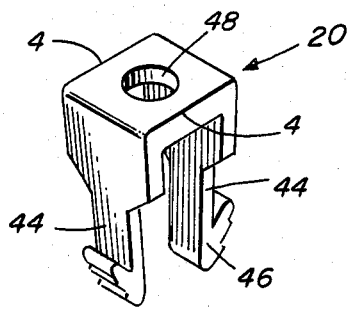
FIG. 4 is a perspective view of the snap-in plugs.
Figure 5:
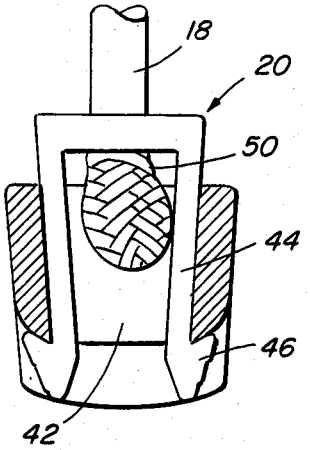
FIG. 5 is a sectional view of the snap-in plug of FIG. 4, taken along line 4—4, positioned within an aperture.

As shown in FIGS. 4 and 5, the flexible elastic cords 18 are connected by means of the snap-in clips 20 within spaced apertures 42 in the upper portion 41 of the connectors 38 and in the contoured handles 16. The apertures 42 are carefully dimensioned to allow the snap-in clips 20 to enter to a point at which the "legs" 44 spread apart to lock the clip 20 within the aperture. In the preferred embodiment, the ends 46 of the clips 20 are angled to facilitate entry of the clip arms 44 into the aperture 42, barbed so the clips are tightly secured within the apertures, and ridged to facilitate gripping the ends 46. The clips 20 are easily removed by squeezing the legs 44 while pushing the clips 20 up and out of the aperture 42.

The elastic cords 18 are inserted into a hole 48 at the upper end of the clips 20 and secured by conventional means such as a metal staple 50. The elastic cords 18 are selected to be a length appropriate for doing isometric, rowing, lifting and stretching exercises for an average sized individual. The tension on the cords 18 can be varied by adjusting the angle of the exercise bar 14 relative to the support bracket 12 or by varying the number of cords 18 between the connectors 38 and the handles 16.

The contoured handles 16, preferably made of moldable plastic, provide a more secure and comfortable grip for the user than the rigid, straight handles of the prior art. The handles 16 are of a sufficient width and length to fit a broad range of hand sizes. Each handle 16 has several spaced apertures 42 for retaining the snap-in clips 20. In the preferred embodiment, each handle 16 has five apertures 42 spread evenly across the base of the handle 16.

Although the preferred device comprises both metal and nylon or plastic, a variety of materials may be used. For example, the entire device could be made from a resilient plastic by injection molding techniques.

The exercise device and various modifications of the device which occur to those skilled in the art from the foregoing detailed description and accompanying drawings are intended to fall within the scope of the appended claims.

I claim:

1. An exercise device comprising:

first support means for securing the device to a structure;

an exercise bar having a central shaft and a cross shaft, said cross shaft extending in a generally perpendicular position across one end of said central shaft, said first support means having a second support means connected thereto, said central shaft being pivotably connected to said second support means and positionable at one or more discrete angles inclined relative to said first support means, said exercise bar further including connectors on said cross shaft, elastic cords; and two handles having a plurality of apertures, wherein said handles are connected to said exercise bar by the elastic cords, said elastic cords being secured by clips positionable within said plurality of spaced apertures in said handles and connectors on said cross shaft.

2. The exercise device of claim 1 wherein said central shaft of said exercise bar includes a spring bar extending perpendicularly across said central shaft and resiliently connected to the pivotal connection between said central shaft and said second support means, said spring bar being movable within an opening in said central shaft along a portion of said central shaft and said second support means having one or more openings extending toward said exercise bar and inclined relative to said first support means, wherein said spring bar extends across said central shaft and is movably positioned within said openings in said second support means to secure said exercise bar at an angle relative to said first support means.

3. The exercise device of claim 1 wherein said clips comprise a resilient material.

4. The exercise device of claim 3 wherein said clips comprise an upper portion and a lower portion, wherein the upper portion is connected to said elastic cord and the lower portion consists of two legs angling outward to facilitate the retention of said clip within said aperture.

5. An exercise device comprising:

first support means for securing the device to a structure;

an exercise bar having a central shaft and a cross shaft, said cross shaft extending in a generally perpendicular position across one end of said central shaft, said first support means having a second support means connected thereto, said central shaft being pivotably connected to said second support means and positionable at one or more angles inclined relative to said first support means, said exercise bar further including connectors on said cross shaft, elastic cords; and two handles having a plurality of spaced apertures, wherein said handles are connected to said exercise bar by the elastic cords, said elastic cords being secured by clips positionable within said plurality of spaced apertures in said handles and connectors on said cross shaft, wherein said handles comprise a grip contoured in the shape of a hand and a base containing a plurality of spaced apertures.

6. An exercise device comprising:

first support means for securing the device to a structure;

an exercise bar having a central shaft and a cross shaft, said cross shaft extending in a generally perpendicular position across one end of said central shaft, said first support means having a second support means connected thereto, said central shaft being pivotably connected to said second support means and positionable at one or more angles inclined relative to said first support means, said exercise bar further including connectors on said cross shaft, elastic cords; and two handles having a plurality of spaced apertures, wherein said handles are connected to said exercise bar by the elastic cords, said elastic cords being secured by clips positionable within said plurality of spaced apertures in said handles and connectors on said cross shaft, wherein said connectors comprise an upper portion with one or more apertures for said clips and a lower portion which encircles said cross shaft of said exercise bar.

7. The exercise device of claim 6 further comprising means for retaining said connectors on said cross shaft.

* * * * *